US009199119B2

(12) United States Patent
Hetrick et al.

(10) Patent No.: US 9,199,119 B2
(45) Date of Patent: Dec. 1, 2015

(54) EXERCISE BAR ATTACHMENT AND METHOD

(75) Inventors: Randal Hetrick, San Francisco, CA (US); Stephanie Russo, San Francisco, CA (US)

(73) Assignee: FITNESS ANYWHERE, LLC, San Francisco, CA (US)

( * ) Notice: Subject to any disclaimer, the term of this patent is extended or adjusted under 35 U.S.C. 154(b) by 813 days.

(21) Appl. No.: 13/307,945

(22) Filed: Nov. 30, 2011

(65) Prior Publication Data

US 2012/0142506 A1 Jun. 7, 2012

Related U.S. Application Data

(60) Provisional application No. 61/418,819, filed on Dec. 1, 2010.

(51) Int. Cl.

| | |
|---|---|
| ***A63B 23/12*** | (2006.01) |
| ***A63B 21/068*** | (2006.01) |
| ***A63B 23/035*** | (2006.01) |
| ***A63B 3/00*** | (2006.01) |
| ***A63B 23/02*** | (2006.01) |

(Continued)

(52) U.S. Cl.

CPC ..... *A63B 23/0216* (2013.01); *A63B 21/00047* (2013.01); *A63B 23/1218* (2013.01); *A63B 23/1227* (2013.01); *A63B 1/00* (2013.01); *A63B 3/00* (2013.01); *A63B 9/00* (2013.01); *A63B 17/04* (2013.01); *A63B 71/023* (2013.01); *A63B 2208/029* (2013.01); *Y10T 29/49826* (2015.01)

(58) Field of Classification Search

CPC ..... A63B 3/00; A63B 7/00; A63B 9/00; A63B 23/1227; A63B 23/1209; A63B 23/12; A63B 23/035

USPC ..... 248/200.1, 201, 210, 211, 238, 77; 211/85.6, 85.7, 86.01, 118; 482/23, 482/38–40, 92–96, 131; D21/662, 679, D21/686, 691, 694

See application file for complete search history.

(56) References Cited

U.S. PATENT DOCUMENTS 2,369,687 A * 2/1945 Ralston ..... 403/403
4,620,701 A * 11/1986 Mojden ..... 482/41

(Continued)

FOREIGN PATENT DOCUMENTS

WO WO 2005-046804 A1 5/2005

OTHER PUBLICATIONS

Patent Cooperation Treaty, "International Preliminary Report on Patentability," issued Jun. 4, 2013 in connection with International Patent Application No. PCT/US2011/062646, 1 page.

(Continued)

*Primary Examiner* — Loan H Thanh
*Assistant Examiner* — Rae Fischer
(74) *Attorney, Agent, or Firm* — Vedder Price P.C.

(57) ABSTRACT

A device and method is described that can easily provide removable exercise bars from the angled portions of a structure and provide a pair of approximately horizontal bars for exercising. The method includes placing an attachment device having a pair of brackets onto co-planar and non-parallel support members. The attachment device brackets include opening for placing, removing, and securing the attachment to the support members. The height of the bars is provided according to the spacing the brackets and the support members.

15 Claims, 11 Drawing Sheets

(51) Int. Cl.

| | |
|---|---|
| ***A63B 21/00*** | (2006.01) |
| *A63B 9/00* | (2006.01) |
| *A63B 17/04* | (2006.01) |
| *A63B 71/02* | (2006.01) |
| *A63B 1/00* | (2006.01) |

(56) References Cited

U.S. PATENT DOCUMENTS

| | | | | | |
|---|---|---|---|---|---|
| 5,011,139 | A | * | 4/1991 | Towley, III | 482/38 |
| 5,261,868 | A | * | 11/1993 | Pryor et al. | 482/142 |
| 5,299,990 | A | * | 4/1994 | Mehlhoff | 482/38 |
| 5,586,957 | A | * | 12/1996 | Wilkinson | 482/74 |
| 7,017,876 | B1 | * | 3/2006 | LeCher | 248/300 |
| 7,621,847 | B2 | * | 11/2009 | Lamle et al. | 482/40 |
| 2006/0100075 | A1 | | 5/2006 | Harsh | |

OTHER PUBLICATIONS

Patent Cooperation Treaty, "Written Opinion of the International Searching Authority" issued Jun. 4, 2013 in connection with International Patent Application No. PCT/US2011/062646, 3 pages.

International Search Report and Written Opinion PCT/US2011/062646, Jul. 9, 2012.

* cited by examiner

EXERCISE BAR ATTACHMENT AND METHOD

CROSS-REFERENCE TO RELATED APPLICATIONS

This application claims the benefit of U.S. Provisional Application No. 61/418,819, filed Dec. 1, 2010, the entire contents of which are hereby incorporated by reference herein and made part of this specification.

BACKGROUND OF THE INVENTION

1. Field of the Invention

The present invention generally relates to exercise equipment, and more particularly to a device including exercise bars that are removably attachable to a frame or structure.

2. Discussion of the Background

Gymnasiums are typically used for a number of exercises, each possibly requiring different equipment and/or configurations of equipment. Since flexibility of the workout space is important, users either have to reconfigure equipment or work with what is available.

While there are some devices which allow for reconfiguring equipment, the mounting, assembly, or reconfiguration exercise space is not, in general, easily done. Specifically, there is no currently available equipment that is sturdy and which allows a user to quickly and easily add or configure bars for a pull up or dip station.

BRIEF SUMMARY OF THE INVENTION

The present invention overcomes the disadvantages of the prior art by providing exercise bars that are easily attachable and removable onto angled support members, such as an A-frame, or to similarly angled elements capable of supporting the bars.

In certain embodiments, a method of providing an exercise bar attachment to a pair of co-planar and non-parallel members is provided, where the attachment includes a pair of brackets separated by a separation distance and configured for mounting on members placed between the brackets. The method includes positioning the pair of brackets adjacent to and on either of the members at a location where the members are separated by a distance of less than the separation distance; and moving the brackets to removably engage the brackets with the members, such that the exercise bar attachment can support the weight of a user on the members.

In certain other embodiments, an exercise bar attachment is provided for mounting on a pair of co-planar, non-parallel support members having a support member included angle. The exercise bar attachment includes a pair of brackets separated by a separation distance, wherein each bracket of the pair of brackets has an opening with a pair of opposing surfaces and a surface joining the opposing surfaces, and wherein the opposing surfaces of the pair of brackets face towards each other and have an included angle approximately equal to the support member included angle; and a pair of grips.

In other embodiments, an exercise bar attachment system is provided. The system includes a pair of co-planar, non-parallel support members having a support member included angle; and an exercise bar attachment. The exercise bar attachment includes a pair of brackets separated by a separation distance, wherein each bracket of the pair of brackets has an opening with a pair of opposing surfaces and a surface joining the opposing surfaces, and wherein the opposing surfaces of the pair of brackets face towards each other and have an included angle approximately equal to the support member included angle; and a pair of grips.

In certain embodiments, brackets for attaching the exercise bar attachment are fixedly attached to the exercise bar attachment, and in certain other embodiments, brackets for attaching the exercise bar attachment are rotatably attached to the exercise bar attachment.

These features together with the various ancillary provisions and features which will become apparent to those skilled in the art from the following detailed description, are attained by the exercise bar attachment device and method of the present invention, preferred embodiments thereof being shown with reference to the accompanying drawings, by way of example only, wherein:

BRIEF DESCRIPTION OF THE SEVERAL VIEWS OF THE DRAWING

FIG. 3 is a top front perspective view, FIG. 4 is a front view 4-4 of FIG. 3, FIG. 5 is a top view 5-5 of FIG. 4, FIG. 6 is a side view 6-6 of FIG. 4, FIG. 7 is a back view 7-7 of FIG. 3, and FIG. 8 is a bottom view 8-8 of FIG. 4;

FIGS. 10A and 10B show a user moving an unattached exercise bar attachment towards the frame, FIGS. 10C, 10D, and 10E show the user engaging the device on the frame, and FIG. 10F shows the user securing the device on the frame;

Reference labels and/or symbols are used in the Figures to indicate certain components, aspects or features shown therein, with reference symbols common to more than one Figure indicating like components, aspects or features shown therein.

DETAILED DESCRIPTION OF THE INVENTION

Figure 1:
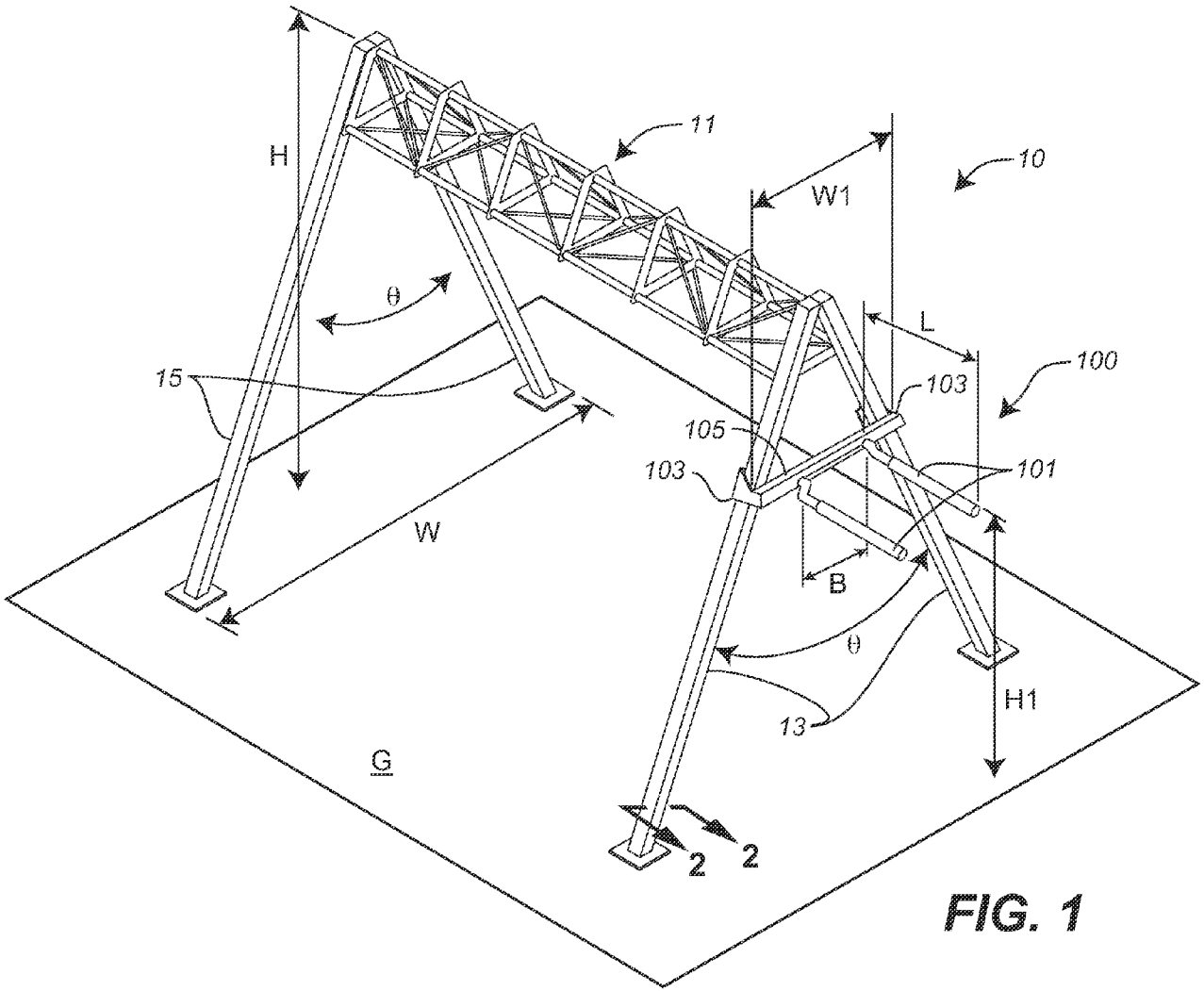
FIG. 1 is a perspective view of a first embodiment exercise bar attachment positioned on a frame.

FIG. 1 is a perspective view of a first embodiment exercise bar attachment 100 supported on a frame 10. In one embodiment, exercise bar attachment 100 includes a pair of bars 101 that may support a user in performing an exercise. While frame 10 is not specifically or necessarily a part of the present invention, the scope of which is to be found in the Claims, frame 10 provides support for frame attachment 100, and thus the following description is provided to illustrate the use exercise bar attachment 100.

For illustrative purposes, frame 10 is shown in FIG. 1 as including two pairs of members 13 and 15 that support a header 11 a height H above ground G. Members 13 and 15 are shown as being joined at header 11 with an included angle Θ extending to a separation width W on ground G. Each pair of members 13 and members 15 are co-planar and non-parallel, and form the legs of an "A-frame" on ground G. Members 13 and/or 15 may also have additional horizontal pieces, not shown, connecting the members.

In general, frame 10 is constructed of rigid components. Thus, for example and without limitation, header 11 and members 13 and 15 may be formed of steel or aluminum pipe or tubing having for example and without limitation, circular, square, triangular, or rectangular cross-sectional shapes. The individual components of frame 10 may be joined by welding, screwing, with brackets, or any other means known for attaching the components.

Thus, for example and without limitation, the height H of frame 10 may be equal to or greater than 7 ft (2.13 m) and may be, for example and without limitation, approximately 7 ft (2.13 m), approximately 7.25 ft (2.21 m), approximately 7.5 ft (2.29 m), approximately 7.75 ft (2.36 m), approximately 8 ft (2.44 m) approximately 8.25 ft (2.51 m), approximately 8.5 ft (2.59 m), approximately 8.75 ft (2.67 m), or approximately 9 ft (2.74 m). The width W of frame 10 may be, for example and without limitation, equal to or greater than approximately 7 ft (2.13 m) and may be, for example, approximately 7 ft (2.13 m), approximately 7.25 ft (2.21 m), approximately 7.5 ft (2.29 m), approximately 7.75 ft (2.36 m), approximately 8 ft (2.44 m), approximately 8.25 ft (2.51 m), approximately 8.5 ft (2.59 m), approximately 8.75 ft (2.67 m), or approximately 9 ft (2.74 m). The angle Θ may accordingly be from approximately 43 to approximately 65 degrees.

Figure 2C:
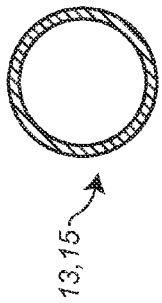
FIGS. 2A, 2B, and 2C are sectional views 2-2 of different embodiments of a frame member, where the member of FIG. 2A has a square cross-section, the member of FIG. 2B has a rectangular cross-section, and the member of FIG. 2C has a circular cross-section.
Figure 2B:
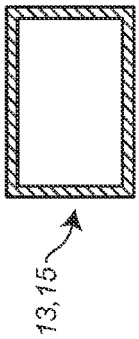
Figure 2A:
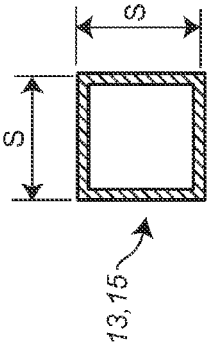

As examples to illustrate members 13 or 15, FIG. 2A is a sectional view 2-2 of FIG. 1 for members having a square cross-section, FIG. 2B is a sectional view 2-2 of FIG. 1 for the members having a rectangular cross-section, and FIG. 2C is a sectional view 2-2 of FIG. 1 for the members having a circular cross-section. The subsequent discussion, illustratively, describes members 13 or 15 having a square cross section. As discussed subsequently, exercise bar attachment 100 configured for attaching to members 13 or 15 having other cross-sectional shapes, including but not limited to those of FIG. 2B or 2C, are within the scope of the present invention.

In one embodiment, which will be illustratively discussed subsequently, member 13 or 15, as shown in FIG. 2A has, for example and without limitation, a square outer shape having sides S of approximately 2 inches (51 mm) on a side, approximately 2.5 inches (64 mm) on a side, approximately 2.75 inches (70 mm) on a side, approximately 3 inches (76 mm) on a side, approximately 3.25 inches (83 mm) on a side, approximately 3.50 inches (89 mm) on a side, approximately 3.75 inches (95 mm) on a side, or approximately 4 inches (102 mm) on a side. In one embodiment, each side S is approximately ⅜ inches (86 mm).

As shown in FIG. 1, exercise bar attachment 100 includes brackets 103 attached to a bar 105 and separated by a distance W1. In general, brackets 103 are adapted to engage with the shape and angle of a pair of members 13, which may or may not be part of frame 10. Brackets 103 may, for example and without limitation, engage members 13 to support bars 101 at height H1 above ground G. Bars 101 each have a length L and spacing B that protrude approximately horizontally away from exercise bar attachment 100, and thus frame 10, a height H1 above ground G. In one embodiment, frame 10 and exercise bar attachment 100 may be configured such that when brackets 103 engage members 13, bars 101 may support the weight of a user, who may, for example and without limitation, use the bars for a pull-up station or a dip station (as discussed subsequently).

In general, exercise bar attachment 100 is constructed of rigid components. Thus, for example and without limitation, the exercise bar attachment 100 may be formed of steel or aluminum pipe or tubing having, for example and without limitation, circular, square, triangular, or rectangular cross-sectional shapes. The individual components of exercise bar attachment 100 may be joined by welding, screwing, or any other means known for attaching the components. In addition, certain components, such as hand grip portions of bars 101, may include padding 131. Bars 101 may also include end-caps or plugs to seal off the end of the bars.

Figure 3:
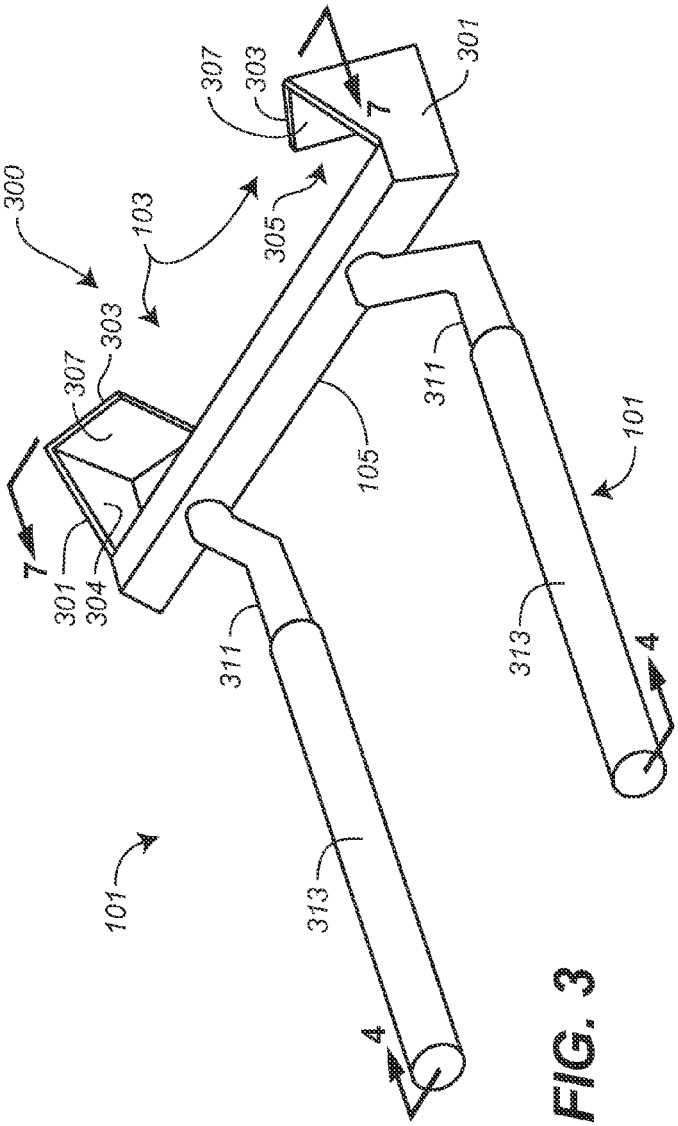
FIGS. 3-8 are views of a second embodiment exercise bar attachment, where
Figure 4:
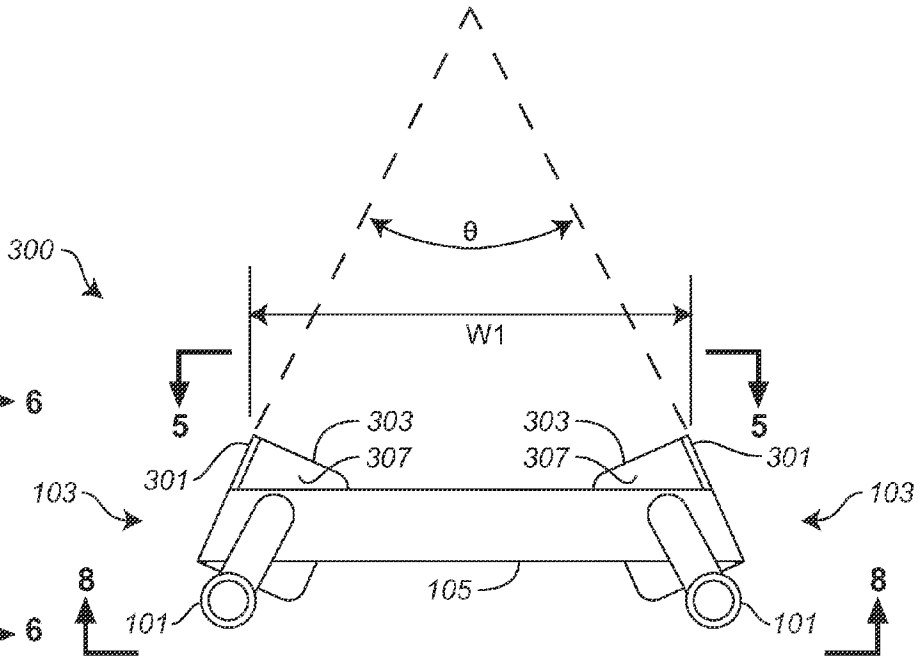
Figure 6:
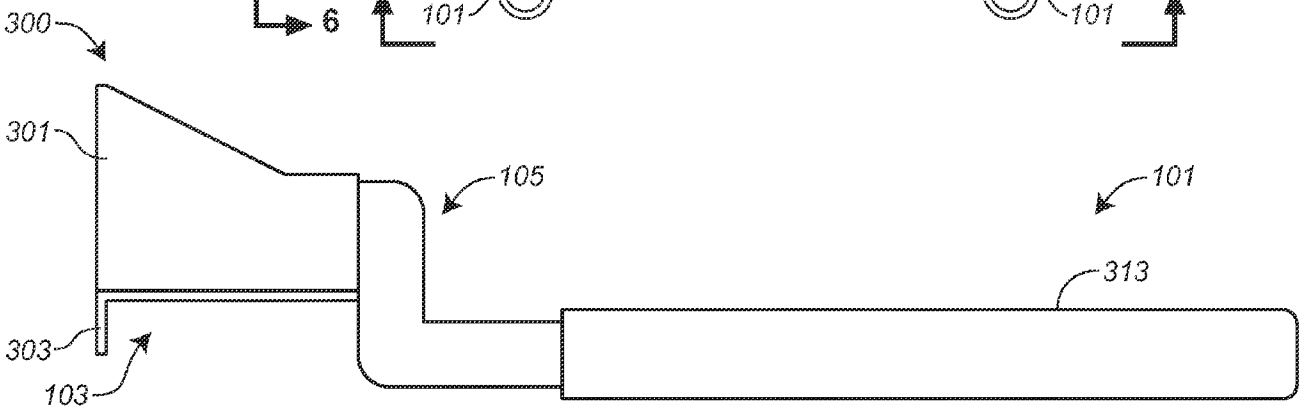
Figure 5:
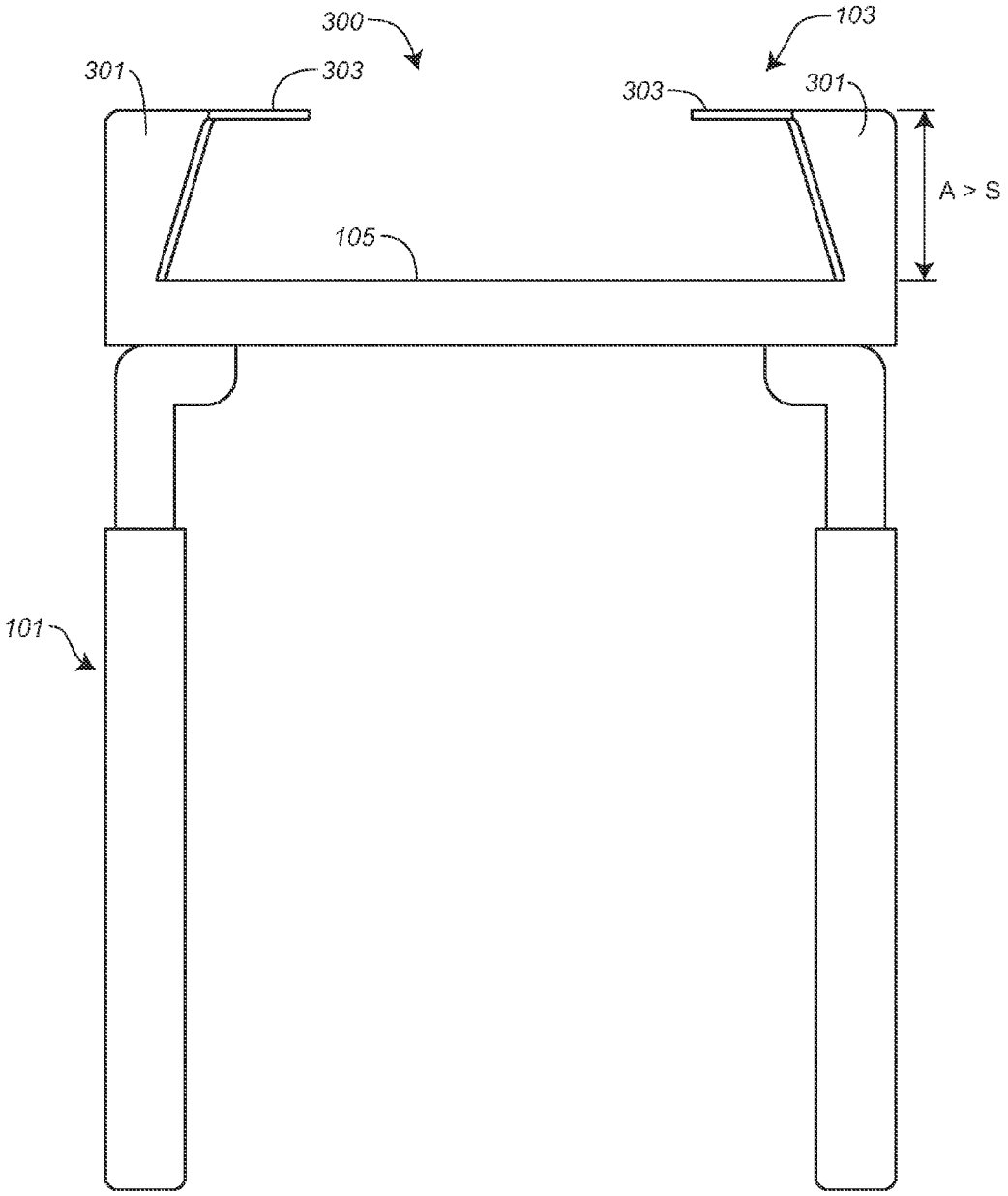
Figure 7:
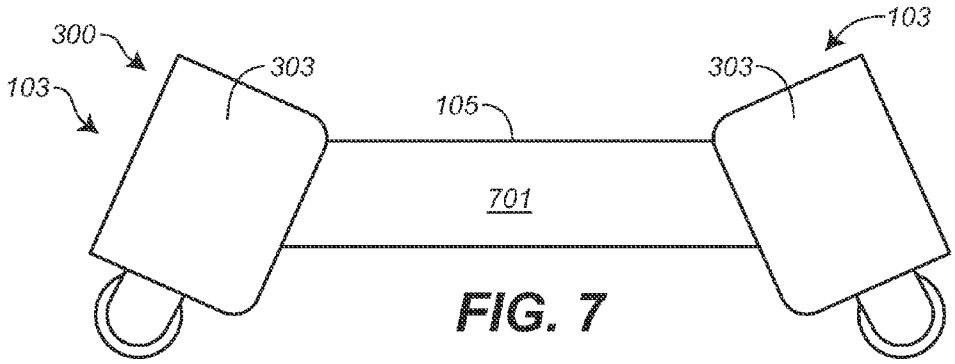
Figure 8:
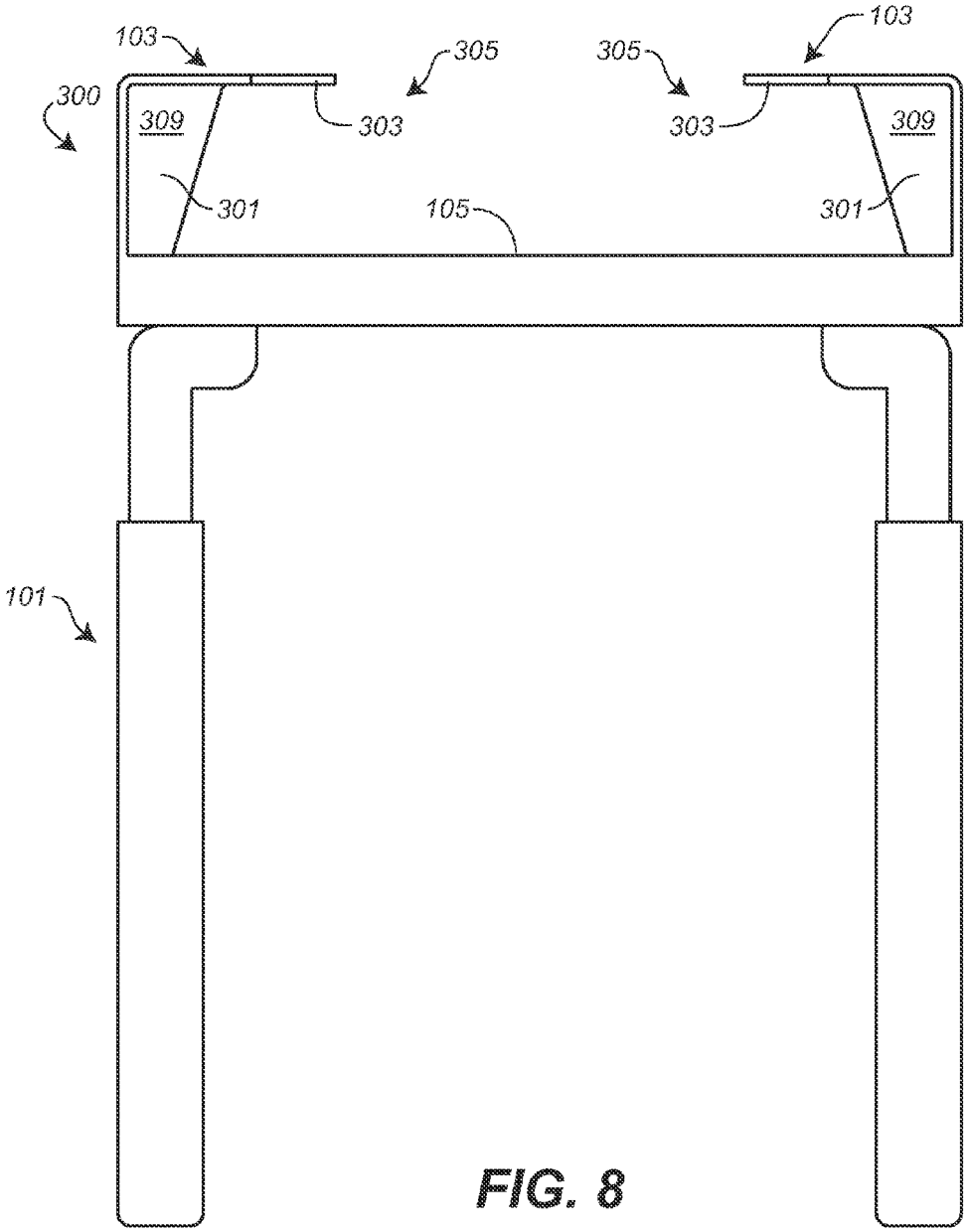

FIGS. 3-8 are views of a second embodiment exercise bar attachment 300, where FIG. 3 is a top front perspective view, FIG. 4 is a front view 4-4 of FIG. 3, FIG. 5 is a top view 5-5 of FIG. 4, FIG. 6 is a side view 6-6 of FIG. 4, FIG. 7 is a back view 7-7 of FIG. 3, and FIG. 8 is a bottom view 8-8 of FIG. 4. Exercise bar attachment 300 may be generally similar to exercise bar attachment 100, except as further detailed below. Where possible, similar elements are identified with identical reference numerals in the depiction of the embodiments of FIGS. 1 through 8. The second embodiment exercise bar attachment 300 is configured, for example and without limitation, to match the angle and cross-sectional shape of members 13. As shown in FIG. 4, exercise bar attachment 300 includes bar 105 and pair of brackets 103 fixedly attached to the bar. Each one of brackets 103 includes a side flange 301 which protrudes away from the bar and a back flange 303 that is attached to the side flange. Bar 105 and each pair of flanges 301 and 303 from an opening 305 which may accept a member 13. Specifically, Bar 105 has a surface 701, as shown in FIG. 7, flange 301 has a surface 309, shown in FIGS. 3 and 8, and flange 303 has a surface 307, shown in FIGS. 3 and 4, where surfaces 701, 307 and 309 form surfaces accessible through opening 305.

Each of the pair of bars 101 includes a metal cylindrical element 311, which may be a bar or tube, which protrudes away from bar 105 on a side opposite brackets 103. An optional soft padding material 313 may also be provided to the outer surface of element 311.

As shown in FIG. 5, flanges 301 include a flat surface angled at the included angle Θ and as shown in FIG. 5 the distance between flange 303 and bar 105 is A, which is slightly greater than S. As one example, which is not meant to limit the scope of the invention, for an S of 3 inches (76 mm), an A of 3⅜ inches (86 mm) provides adequate clearance for placing and removing exercise bar attachment 300 from frame 10. Brackets 103 thus match the pair of members 13, and will support a person by bars 101. Surfaces 710, 307, and/or 309 may also include a protective coating for that portion that contacts members 13.

Figure 9:
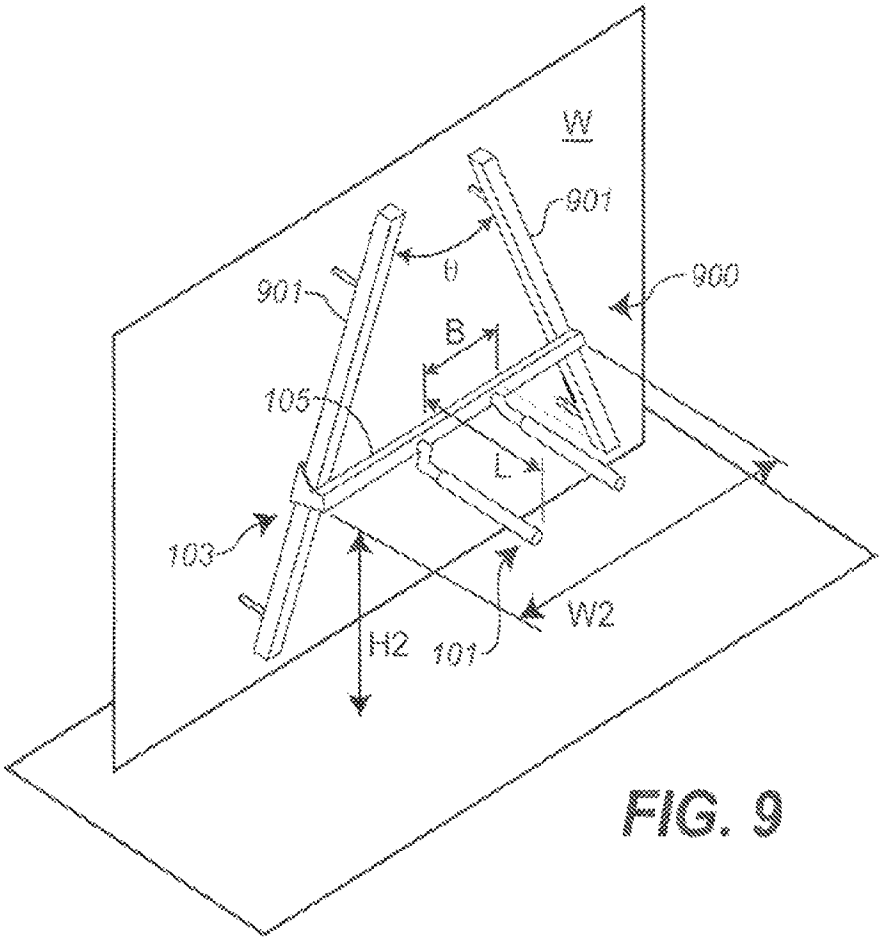
FIG. 9 is a perspective view a third embodiment exercise bar attachment.

With reference to FIGS. 1 and 9, in certain embodiments, bars 101 may be used for pull-ups or dips. The bars 101 may be separated by a distance B and each have a length L. As such the dimensions B and L may have, for example and without limitation, the following values. Specifically, B may be from approximately 12 inches (0.3 m) to approximately 24 inches (0.6 m). In certain other embodiments, B is approximately 13 inches (0.33 m), approximately 14 inches (0.36 m), approximately 15 inches (0.38 m), approximately 16 inches (0.41 m) or approximately 17 inches (0.43 m). In certain embodiment, L is from approximately 12 inches (0.3 m) to approximately 24 inches (0.6 m). In certain other embodiments, L is approximately 14 inches (0.36 m), approximately 15 inches (0.38 m), approximately 16 inches (0.41 m), approximately 16.5 inches (0.42 m), approximately 17 inches (0.43 m), or approximately 18 inches (0.46 m).

Bars 101 may have a diameter, inclusive of any padding, of from approximately 1 inch (25 mm) to approximately 2 inches (51 mm), and may be, for example and without limitation, approximately 1 inch (25 mm), approximately 1.25 inches (32 mm), approximately 1.5 inches (38 mm), approximately 1.75 inches (44 mm), or approximately 2 inches (51 mm).

FIG. 9 is a perspective view a third embodiment exercise bar attachment 900. While exercise bar attachment 900 may be mounted on frame 10, it may, alternatively, be mounted on a pair of members 901, having the same cross-sectional dimensions and included angle as members 13, may be mounted on a wall W, as shown in FIG. 9. Exercise bar attachment 900 may be generally similar to exercise bar attachment 100 or 300, except as further detailed below. Where possible, similar elements are identified with identical reference numerals in the depiction of the embodiments of FIGS. 1 through 9.

Third embodiment exercise bar attachment 900 is generally similar to embodiment exercise bar attachments 100 or 300, except that brackets 103 of the third embodiment exercise bar attachment have a spacing W2 which is larger than spacing W1 of the first embodiment exercise bar attachment.

The larger spacing permits exercise bar attachment 900 to be located at a different height above ground G than exercise bar attachment 100 or 300 Thus, for example, if exercise bar attachment 900 is placed on members 13 or 15 of frame 10, since members 13 and 15 are angled towards each other with increasing distance from ground G, exercise bar attachment 900 engages members 13 at a height H2 above ground G, where height H2 is less than height H1 of exercise bar attachment 100 or 300 Exercise bar attachment 900 may thus provide bars 101 for a dip station at a height H2, for example, of 3.5 ft (1.1 m).

Figure 10A:
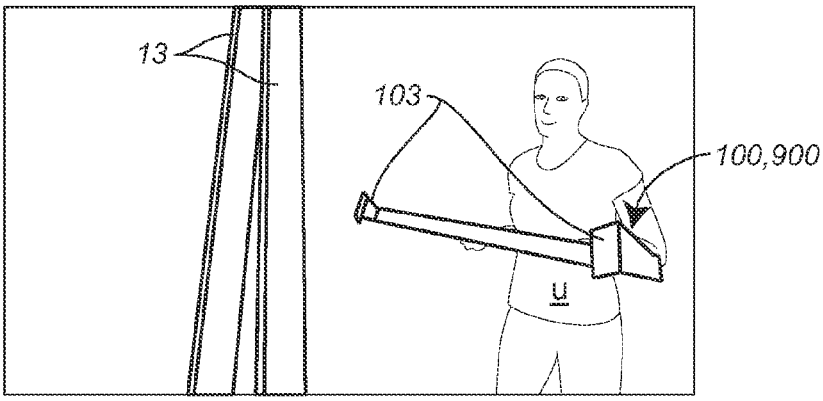
FIGS. 10A-10F illustrate the attachment of an exercise bar attachment onto the frame members, where
Figure 10B:
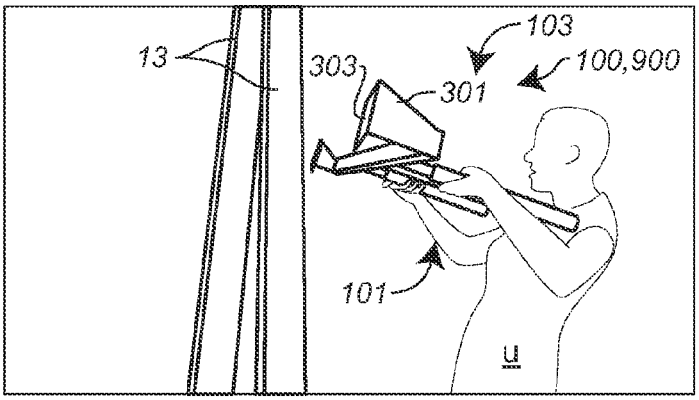
Figure 10C:
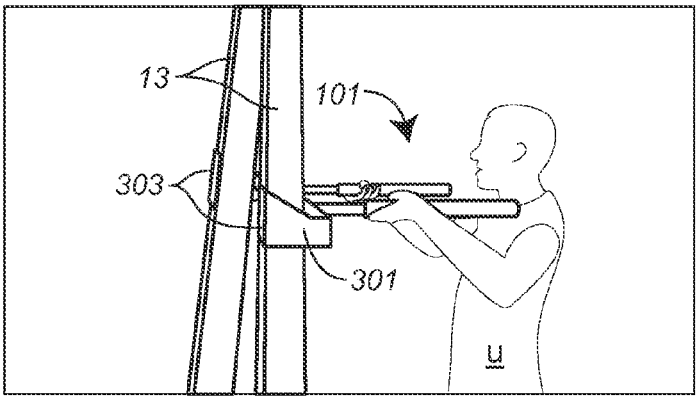
Figure 10D:
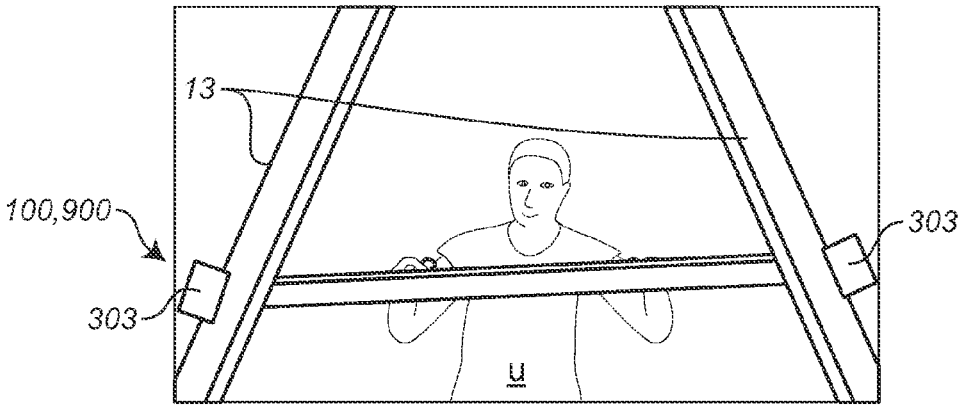
Figure 10E:
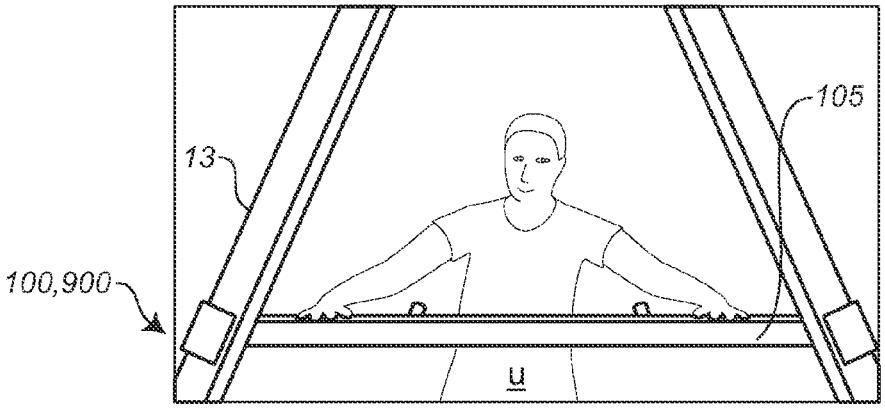
Figure 10F:
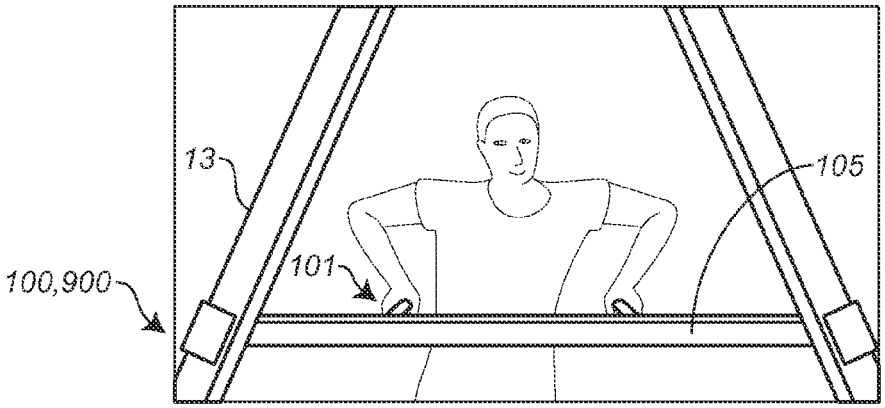

FIGS. 10A through 10F illustrate the attachment of the exercise bar attachment 100, 300 or 900 on members 13 of frame 10, where FIGS. 10A and 10B show a user U moving exercise bar attachment 100 or 900 towards the frame, FIGS. 10C, 10D, and 10E show the user engaging exercise bar attachment 100 or 900 on to the frame, and FIG. 10F shows the user securing exercise bar attachment 100 or 900 on to the frame.

More specifically, FIG. 10A shows user U picking up exercise bar attachment 100 or 900. Since the individual members 13 are closer together further from the ground, FIG. 10B shows the user maneuvering brackets 103 towards members 13 at a height that is greater than what will be the engaged position of exercise bar attachment 100 or 900.

FIGS. 10C and 10D are different views showing back flange 303 being maneuvered behind members 13, with side flanges 301 on the outer portions of members 13. FIG. 10E shows user U lowering exercise bar attachment 100 or 900 on to members 13, and FIG. 10F shows the user pulling down on bars 101 to secure the exercise bar attachment 100 onto members 13. Bars 101 of exercise bar attachment 100 or 900 are ready for use in exercising. Exercise bar attachment 100 or 900 may be removed by reversing the steps of FIGS. 10A-F.

ALTERNATIVE EMBODIMENTS

Figure 11C:
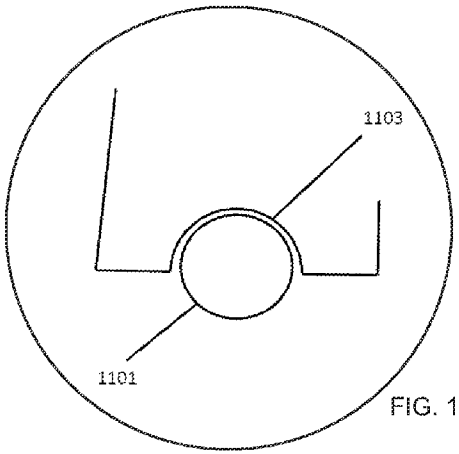
FIG. 11A is a perspective view illustrating a first alternative embodiment exercise bar attachment placed on frame members.
FIG. 11B is a perspective view showing detail of the exercise bar attachment of FIG. 11A.
Figure 11B:
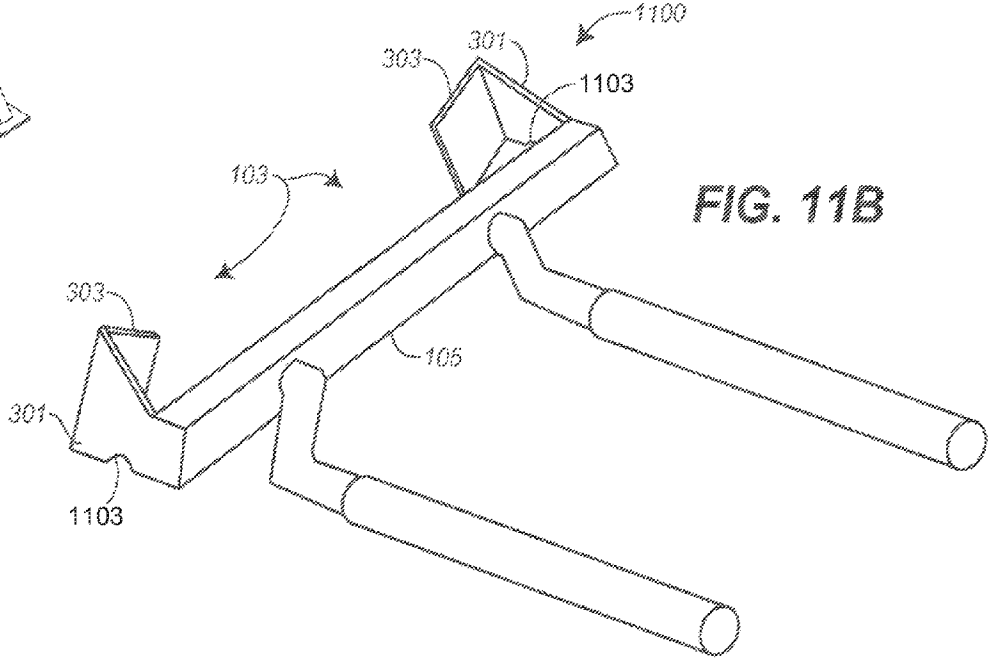
Figure 11A:
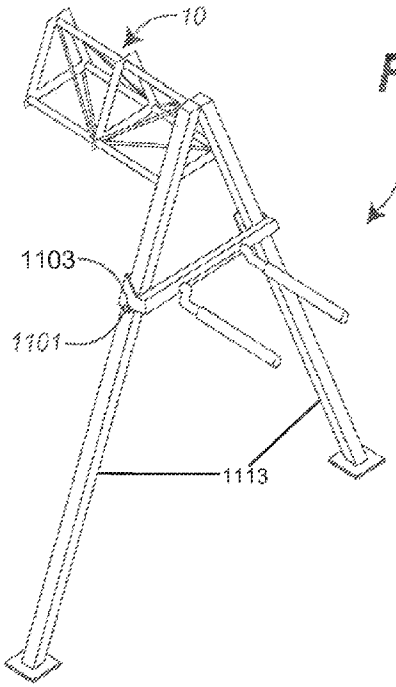

FIGS. 11A and 11B illustrate a first alternative embodiment exercise bar attachment 1100 and FIGS. 12, 13, 14A and 14B illustrate a second alternative embodiment exercise bar attachment 1200. Exercise bar attachments 1100 and 1200 include elements or features, as discussed subsequently, which may be included into exercise bar attachment 100, 300 or 900. Exercise bar attachments 1100 and 1200 may be generally similar to exercise bar attachment 100, 300 or 900, except as further detailed below. Where possible, similar elements are identified with identical reference numerals in the depiction of the embodiments of FIGS. 1 through 14.

FIG. 11A is a perspective view illustrating first alternative embodiment exercise bar attachment 1100 placed on frame members 1113 and FIG. 11B is a perspective view showing detail of the first alternative exercise bar attachment.

As shown in FIG. 11B, exercise bar attachment 1100 includes a notch 1101 on side flanges 301 of each bracket 103. Exercise bar attachment 1100 may be used with members 13, 15, or 901. Alternatively, FIG. 11A illustrates the use of exercise bar attachment 1100 with members 1113. Members 1113 are generally the same as members 13, and also include a protrusion 1103 on the outer side of members 1113. Protrusion 1103 may be, for example and without limitation, a bolt or a short piece of metal welded to members 1113. Protrusion 1103 is positioned on members 1113 such that protrusion 1103 sits within notch 1101 when exercise device 1100 is supported by members 1113. The combination of protrusion 1103 and notch 1101 allows the user to more easily and positively locate the position of the exercise bar attachment onto members 1113, which may be part of a frame 10.

Figure 12:
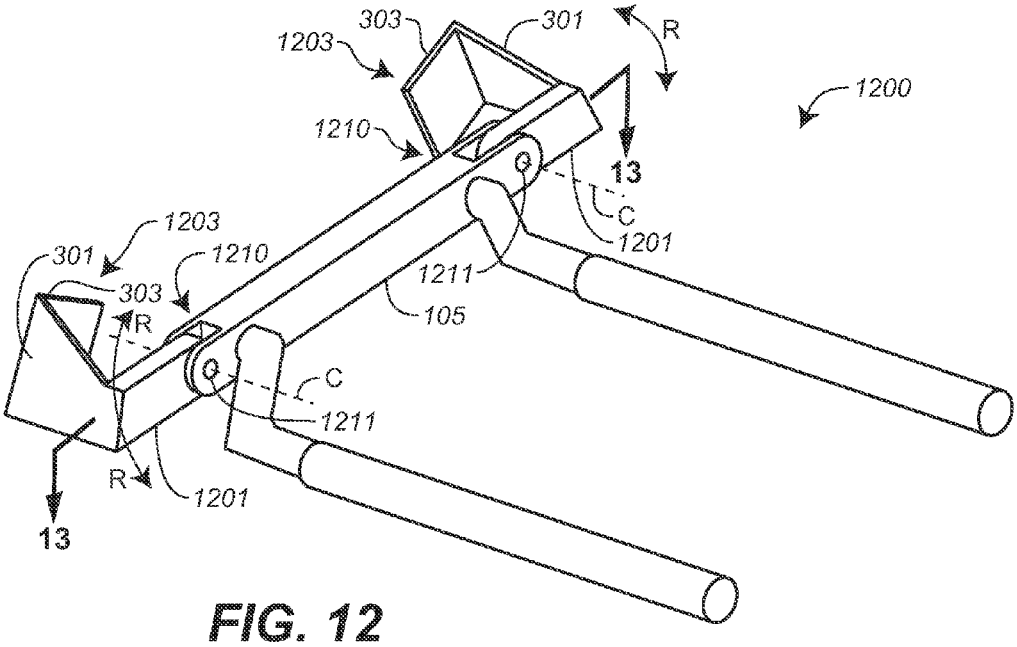
FIG. 12 is a perspective view of a second alternative embodiment exercise bar attachment.
Figure 13:
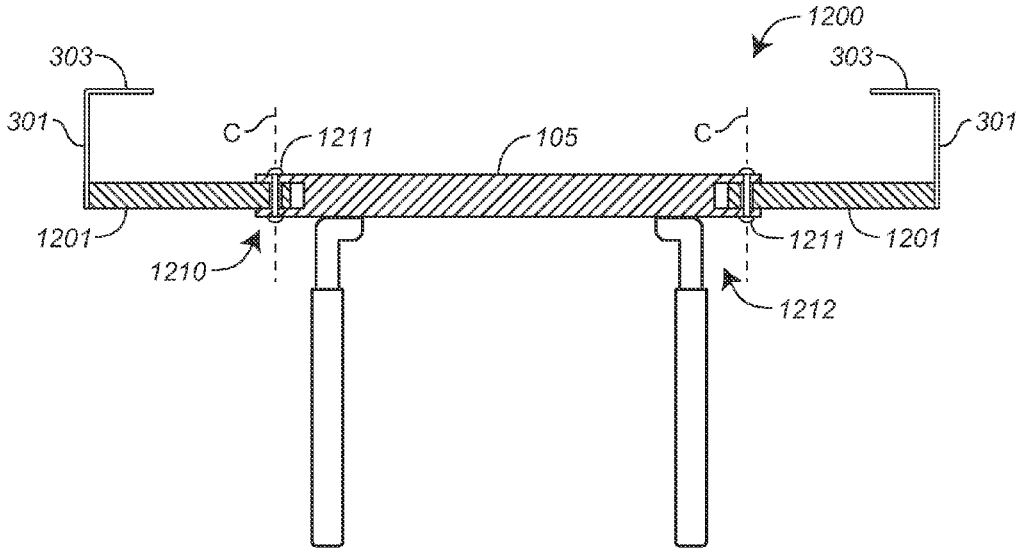
FIG. 13 is a sectional view 13-13 of FIG. 12.

FIG. 12 is a perspective view of exercise bar attachment 1200 and FIG. 13 is a sectional view 12-12 taken along bar 105. In contrast to brackets 103 of FIGS. 3-8, which are fixedly attached exercise bar attachment 300, exercise bar attachment 1200 includes a pair of hinged brackets 1203 which are each rotatably attached to a bar extension 1201. Exercise bar attachment 1200 is thus capable of engaging non-parallel members having a range of included angles, as described subsequently.

Each hinged bracket 1203 includes a bar extension 1201 connected to bar 105 by a hinge 1210 including a hinge pin 1211, which defines a center line C about which each hinge 1210 may rotate as indicated by arrows R. Each hinged bracket 1203 also includes side flange 301 which protrudes away from bar extension 1201 and a back flange 303 that is attached to the side flange, thus permitting engagement with members, such as members 13.

Figure 14A:
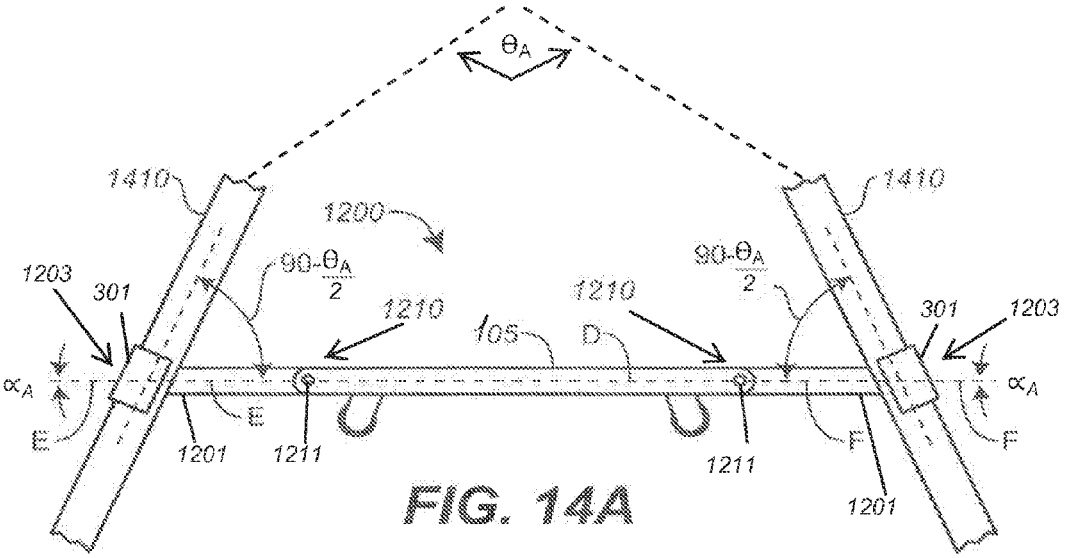
FIGS. 14A and 14B are front views of the exercise bar attachment of FIG. 12 as attached to a pair of members (FIG. 14A) and a second pair of members (FIG. 14B).
Figure 14B:
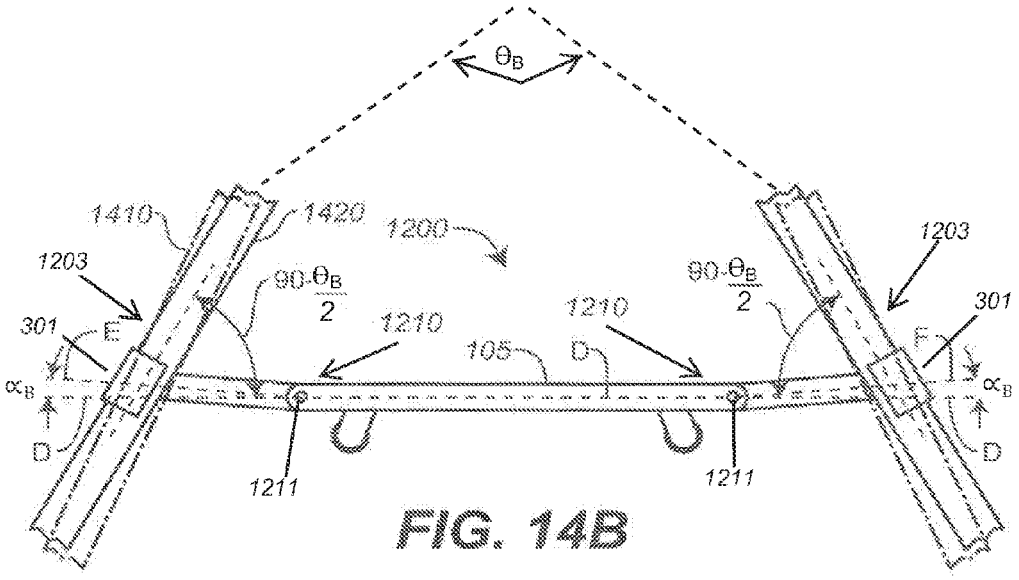

FIGS. 14A and 14B are front views illustrative of the use of exercise bar attachment 1200 on two different co-planar and non-parallel members, members 1410 and 1420, respectively, and are not meant to limit the scope of the invention. Members 1410 and 1420 are generally similar to members 13, except that they have different included angles. In FIG. 14A, members 1410 have an included angle of $\Theta_A$, and thus the angle between each member and the horizontal is $90\text{-}\Theta_A/2$, and in FIG. 14B members 1420 have an included angle of $\Theta_B$, and thus the angle between each member and the horizontal is $90\text{-}\Theta_B/2$.

FIGS. 14A and 14B also show a reference line D which is perpendicular to and extends through both hinges 1211, and reference lines E and F which each are perpendicular to the hinge and extent along one of bar extensions 1201.

In the example of FIG. 14A, bar extensions 1201 are straight extensions of bar 105—that is, lines D, E, and F are co-axial, having an angle $\alpha_A=0$. In this embodiment, brackets 1203 engage members 1410, for example by flanges 301 contacting members 1410. In the example of FIG. 14B, members 1420 have a larger included angle than members 1410, and thus for flanges 301 to contact members 1420, the bar extension 1201 is angled relative to bar 105 by an angle $\alpha_B$.

It is thus seen that by providing some degree of rotation about axis C, exercise bar attachment 1200 may accommodate and be attachable to a range of included angles. In one extreme, exercise bar attachment 1200 may attach to two bars having an included angle of 180 degrees (which may be a single bar). In another extreme, exercise bar attachment 1200 may attached to two bars that are nearly parallel and which have a very small included angle, such as a few degrees.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments. Thus, for example one or both brackets may have a notch, such as notch 1101 and/or have a hinge, such as hinge 1210

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment.

We claim:

1. An exercise bar attachment for mounting on a pair of co-planar and non-parallel support members having a support-member included angle that is predetermined and each support member having a support-member surface, the exercise bar attachment comprising:

a horizontal bar with a pair of hinges disposed on the ends thereof;

a pair of brackets, each configured to be mounted on one of the pair of support members, and each bracket having an opening described by a pair of opposing surfaces and a bracket surface joining the opposing surfaces wherein the two bracket surfaces face towards each other and describe a bracket included angle, and wherein each of the bracket surfaces may rotate independently with respect to the horizontal bar such that the bracket included angle is approximately equal to the support member included angle; and a pair of grips attached to the horizontal bar.

2. The exercise bar attachment of claim 1, wherein said pair of grips is a pair of parallel bars wherein the pair of parallel bars extends perpendicular to the support members when the brackets engage the support members.

3. The exercise bar attachment of claim 1, wherein said support member included angle is from approximately 43 degrees to approximately 65 degrees.

4. The exercise bar attachment of claim 1, wherein each of the support members has a protrusion, and wherein each bracket of said pair of brackets has a notch to engage the protrusion.

5. An exercise bar system comprising:

a pair of co-planar and non-parallel support members having a support-member included angle that is predetermined and each support member having a support-member surface;

a horizontal bar with a pair of hinges disposed on the ends thereof;

a pair of brackets, each configured to be mounted on one of the pair of support members, and each bracket having an opening described by a pair of opposing surfaces and a bracket surface joining the opposing surfaces wherein the two bracket surfaces face towards each other and describe a bracket included angle, and wherein each of the bracket surfaces may rotate independently with respect to the horizontal bar such that the bracket included angle is approximately equal to the support member included angle; and a pair of grips attached to the horizontal bar.

6. The exercise bar system of claim 5, wherein said pair of grips is a pair of parallel bars wherein the pair of parallel bars extends perpendicular to the support members when the brackets engage the support members.

7. The exercise bar system of claim 5, wherein said support-member included angle is from approximately 43 degrees to approximately 65 degrees.

8. The exercise bar system of claim 5, wherein each of the support members has a protrusion, and wherein each bracket of said pair of brackets has a notch to engage the protrusion.

9. The exercise bar system of claim 5, wherein said support members are attached to a wall.

10. The exercise bar system of claim 5, wherein said support members are portions of a frame.

11. A method comprising:

providing an exercise bar attachment for mounting on a pair of co-planar and non-parallel support members having a support-member included angle that is predetermined and each support member having a support-member surface, where the exercise bar attachment includes:

a pair of brackets separated by a bracket separation distance, each bracket rotatably attached by a hinge to a horizontal bar placed between the brackets and configured for mounting on one of the support members, wherein each bracket of the pair of brackets has an opening described by a pair of opposing surfaces and a bracket surface joining the opposing surfaces and wherein the two bracket surfaces face towards each other and describe a bracket included angle, and a pair of grips;

positioning the brackets adjacent to and on the outer side of a respective support member at a location where the support members are separated by a distance of less than the bracket separation distance such that the support-member surface of each of the support members is adjacent to and spaced apart from the opposing surfaces and the bracket surface of one of the brackets;

rotating each of the brackets independently such that the bracket included angle is approximately equal to the support-member included angle; and moving the brackets to removably engage with the support members, such that the support-member surfaces are in contact with the bracket surfaces and the exercise bar attachment can support the weight of a user on the support members.

12. The method of claim 11, wherein positioning includes positioning each co-planar and non-parallel member within the opening of the respective bracket.

13. The method of claim 12, wherein each of the support members includes a protrusion from the surface thereof, where the distance between the protrusions is approximately the separation distance, and wherein moving includes lowering each bracket of the pair of brackets to one of the protrusions such that each bracket is in contact with the protrusion of the co-planar and non-parallel member it engages.

14. The method of claim 11, wherein said support-member included angle is from approximately 43 degrees to approximately 65 degrees.

15. The method of claim 11, wherein the pair of grips extends perpendicular to the support members when the brackets engage the support members.

* * * * *